United States Patent [19]

Christianson

[11] Patent Number: 4,565,370

[45] Date of Patent: Jan. 21, 1986

[54] FOOT HOLDING DEVICE FOR HANGING UPSIDE-DOWN

[76] Inventor: Tony Christianson, 120 8th St., Manhattan Beach, Calif. 90266

[21] Appl. No.: 434,187

[22] Filed: Oct. 12, 1982

Related U.S. Application Data

[63] Continuation-in-part of Ser. No. 363,601, Mar. 30, 1981, abandoned.

[51] Int. Cl.[4] ..... A63B 23/02

[52] U.S. Cl. ..... 272/145; 272/900; 128/75

[58] Field of Search ..... 128/71, 75, 94, 84 R; 272/144, 145, 62, 109, 121; D8/367; 224/250

[56] References Cited

U.S. PATENT DOCUMENTS

| | | | |
|---|---|---|---|
| 937,354 | 10/1909 | Amos | 128/84 R |
| 2,050,269 | 8/1936 | Brooks | 128/94 X |
| 2,511,182 | 6/1950 | Spencer | 128/84 R |
| 2,583,895 | 1/1952 | Siebrandt | 128/84 R |
| 2,723,663 | 11/1955 | Davis | 128/75 |
| 3,380,447 | 4/1968 | Martin | 128/75 |
| 3,612,046 | 10/1971 | Gaylord | 128/75 |
| 3,720,206 | 3/1973 | Walker et al. | 128/75 X |
| 3,978,853 | 9/1976 | Morrison | 128/84 R |

*Primary Examiner*—Richard J. Apley
*Assistant Examiner*—David J. Brown
*Attorney, Agent, or Firm*—Spensley Horn Jubas & Lubitz

[57] ABSTRACT

This foot holding device for hanging upside down includes an elongated, wide flexible web which is looped so that the two ends thereof overlap, together with holding means for removable attachment of the device to a structural member and a connector extending through the overlapping ends of the web and engaging the holding means. The first end of a unitary closing and heel strap is attached to one end of the web, and the second end of the unitary strap is removably attachable to the other end of the web.

11 Claims, 12 Drawing Figures

FOOT HOLDING DEVICE FOR HANGING UPSIDE-DOWN

This is a continuation-in-part or the inventor's co-pending application Ser. No. 363,601 filed March 30, 1981 now abandoned.

BACKGROUND OF THE INVENTION

1. Field of the Invention

The present invention relates to a foot holding device and more particularly to a foot holding device for suspending a person upside-down by the feet.

2. Description of the Prior Art

Hanging upside-down by the feet is a means to: (a) decompressing and stretching the spinal column thereby relieving back stress and associated back pain, (b) easy performance of flexion and extension exercises thereby improving trunk muscle tone and flexibility, (c) increased blood flow to the upper body as an aid to circulatory function, and (d) overall relaxation.

Several devices have been developed either for the purpose of hanging upside-down or for the related purpose of placing the leg in traction. One such device is disclosed by Siebrandt's U.S. Pat. No. 2,583,895 issued Jan. 29, 1952 entitled FOOT TRACTION HITCH. The Siebrandt device utilizes a U-shaped frame with generally parallel arms pinned on both sides of the foot to a pair of straps, one of which passes over the top of the foot, and the other around the heel. The Siebrandt device holds the foot in traction during reduction of a fractured leg and while applying a cast. The Siebrandt device is complex, bulky, requires a second individual to apply, and, as such, is not a practical or convenient means for hanging upside-down.

Another device is disclosed in Martin's U.S. Pat. No. 3,380,447 issued April 30, 1968 entitled ANKLE DEVICE FOR SUPPORTING AN INDIVIDUAL IN AN INVERTED POSITION. Martin's device is a foam padded rigid cuff which fits around the leg near the ankle and incorporates a hook means for attachment to an overhead horizontal bar. With Martin's device, the weight of the body is distributed over a relatively narrow band around the foot adjacent the ankle. This concentration of force is uncomfortable and can restrict blood flow to the foot. In addition, location of the hook means in front of the leg, offset from the long axis of the body, produces a torque force on the ankle and lower leg which detracts from comfort and may have adverse physiological effects. Another problem associated with Martin's device is the possibility that an extended or pointed foot can slip out of the device and thereby drop the user. Yet another problem of the Martin device is its relatively bulky, heavy and expensive construction.

The present invention solves all the problems presented by both the Siebrandt and Martin devices.

SUMMARY OF THE INVENTION

The objective of the present invention is to facilitate hanging upside-down by the feet. This objective is achieved by the inventive device in the following ways: (a) the device is conveniently and easily attached by an individual to his foot, (b) the device provides the means for hooking directly onto an overhead supporting structure, (c) the device is attached to and secured on the foot so that it is properly oriented for hooking onto an overhead supporting structure, (d) the device comfortably, reliably and securely holds the foot of a person hanging upside-down such that body weight is safely supported, and (e) the device supports body weight in line with the long axis of the body without twisting or applying torque to the leg, ankle or foot.

Another objective of the present invention is to provide a foot holding device for hanging upside-down which can be folded into a relatively small package for ease of storage and transportation.

Another objective of the present invention is to provide a foot holding device for hanging upside-down which is relatively lightweight.

Another objective of the present invention is to provide a foot holding device for hanging upside-down which is simple and economical to manufacture.

BRIEF DESCRIPTION OF THE DRAWINGS

A detailed description of the invention will be made with reference to the accompanying drawings wherein like numerals designate corresponding parts in the several figures.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention since the scope of the invention is best defined by the appended claims.

Figure 1:
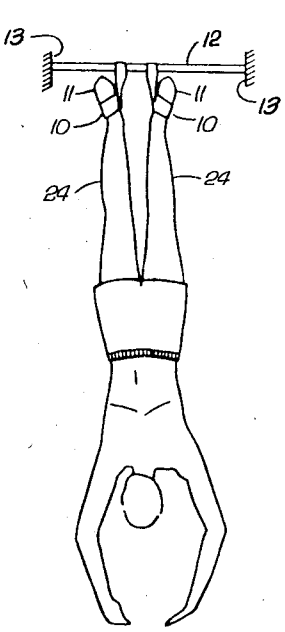
FIG. 1 is a front view illustrating a person hanging upside-down by a foot holding device which is attached to a horizontal bar.

The inventive foot holding device 10 supports a person upside-down by the feet 11 after hooking onto a overhead supporting structure such as horizontal bar 12, fixed at its ends 13, as shown in FIG. 1. Total support of a person's body weight is provided by two (2) foot holding devices, one for each foot.

Figure 4:
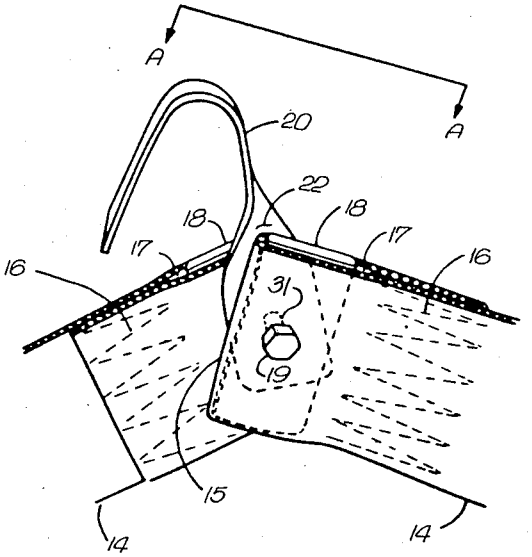
FIG. 4 is a close-up view of the hooking means, webbing ends, and common bolt attachment.
Figure 3:
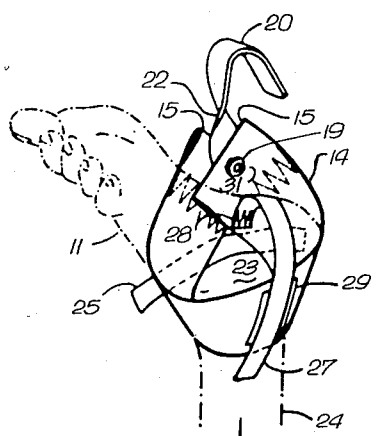
FIG. 3 is a side view of the foot holding device as viewed toward the outside of the foot. A secured foot is represented in the figure by dot-dash phantom lines.
Figure 2:
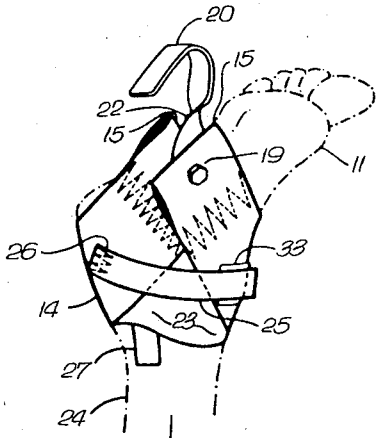
FIG. 2 is a side view of the foot holding device as viewed toward the inside of the foot. A secured foot is represented in the figure by dot-dash phantom lines.

The inventive device has the configuration shown in FIGS. 2 and 3, and includes a looped 23 length of wide flexible webbing 14, typically three (3) inches wide and fifteen (15) to seventeen (17) inches long. As shown in FIG. 4, the ends 15 of the webbing 14 are folded over and securely stitched 16 so as to provide a pocket 17 for insertion of a rigid flat bar 18. A hole 21 punched thru webbing ends 15 and centered thru bar 18 enables penetration of bolt 19. Bar 18 is typically metalic, $\frac{1}{8}$ inch thick, $1\frac{1}{4}$ inches wide and three (3) inches long. Bar 18 functions to distribute along the entire width of webbing 14 all loads transmitted by bolt 19.

A twisted rigid hook 20 with hole 21 centered near the twisted end is sandwiched between webbing ends 15 and commonly pinned by bolt 19. Bolt 19 is secured by nut 31 (shown in FIGS. 3 and 5). Hook 20 is typically formed from a metalic strip $1\frac{1}{4}$ inches wide and $\frac{1}{8}$ inch thick. Webbing ends 15 and hook 20 rotate freely about common bolt 19.

Figure 5:
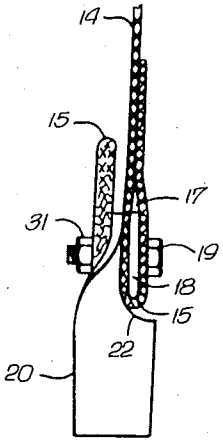
FIG. 5 is a partial top view as seen in the direction A—A of FIG. 4.

As shown in FIGS. 4 and 5, twist 22 of hook 20 acts as a mechanical stop which limits rotational movement of webbing ends 15 relative to hook 20 such that hook 20 is always directed away from the opening formed by loop 23 of webbing 14.

Additionally, when a person is supported upside-down by the inventive foot holding device, because the looped webbing ends 15 and hook 20 are free to rotate about common bolt 19, tension force 30, as a result of body weight, is directed away from hook 20 along leg 24 exactly in line with the long axis of the body. Furthermore, tension force 30 serves to pull the opening formed by loop 23 closed thereby tightening webbing 14 about foot 11. This tightening action grabs and securely holds the foot so as to prevent inadvertant release for so long as tension is applied. Conversely, when tension is not applied, loop 23 will easily open to facilitate removal or replacement of the foot.

The relatively wide webbing 14, which holds and supports the foot 11, distributes tension force 30 over a wide area of the foot. Pressure against blood vessels with a resultant reduction of blood flow along the top of the foot is thereby minimized. Furthermore, comfort is maximized because body weight is distributed over a wide area of the foot.

Figure 6:
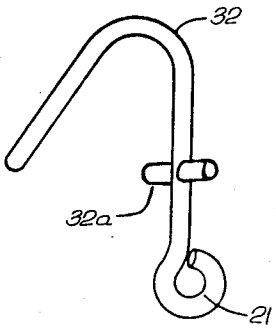
FIG. 6 illustrates an alternate hook configuration.

FIG. 6 illustrates an alternate hook configuration 32 which does not feature the rotational movement limiting twist 22 of the preferred hook configuration 20. The hook 32 of FIG. 6 can be typically fabricated by forming $\frac{3}{8}$ inch diameter rigid rod. However, optional protruding tabs 32*a* can be attached to the hook 32 to limit such relative motion.

Illustrated in FIG. 2 is a closing strap 25 of flexible material typically óne (1) inch wide and seven (7) inches long. Strap 25 is attached at one of its ends by stitching 26 near one end of webbing 14. The other end of strap 25 is removably and adjustably attached near the other end of webbing 14 by means of a hook and loop fastener 33 of the type comercially referred to as Velcro. Although the use of a hook and loop fastener is the preferred configuration, any one of many types of fasteners or buckles can be used for the same purpose. The closing strap 25 functions to hold the loop 23 closed about the foot when tension is not applied, as when, for example, the foot holding device is mounted on the foot prior or after hooking onto an overhead support structure.

Illustrated in FIG. 3 is a heel strap 27 of flexible material typically one (1) inch wide and ten (10) inches long. Strap 27 is attached at one of its ends by stitching 28 near pivot bolt 19. The other end of strap 27 is removably and adjustably attached near the center of loop 23 by means of hook and loop fastener 29 of the type comercially referred to as Velcro. Although the use of a hook and loop fastener is the preferred configuration, any one of many types of fasteners or buckles can be used for the same purpose. The heel strap 27 functions to keep the foot holding device from sliding along the leg when tension is not applied, as when, for example, the user is manually maneuvering his body upside-down in preparation to hooking onto an overhead support structure.

The overhead support structure illustrated in FIG. 1 is a horizontal bar 12. The inventive foot holding device 10 is not limited to use with horizontal bars. For example, the foot holding device 10 can be hooked onto large eyescrews, or the like, securely fixed to an overhead beam.

Flexible webbing 14 and attached flexible straps 25 and 27 can be folded around hook 20 to form a relatively small and lightweight package for ease of storage and transportation.

Aditionally, the materials required to fabricate the inventive foot holding device are readily available. The fabrication techniques are well known and inexpensive. Consequently, the foot holding device 10 can be manufactured at low cost.

As shown in FIG. 5, bolt 19 is secured by nut 31. Nut 31 should be of the self-locking variety to maintain tightness. Alternately, the threaded end of bolt 19 can be peened against nut 31 to maintain tightness. Furthermore, other types of fasteners can be used in place of bolt 19 and nut 31. For example, a rivet or pinned clevis pin can be used for the same purpose.

Figure 7:
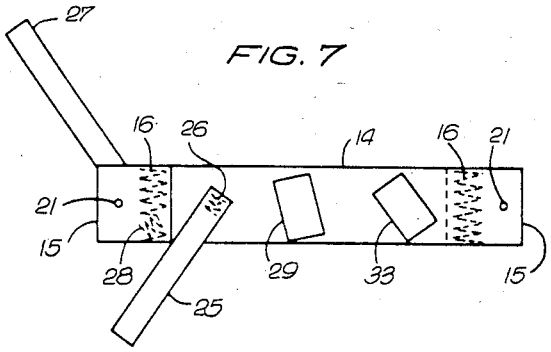
FIG. 7 is a top view of the webbing component of the foot holding device laid out flat.
Figure 8:
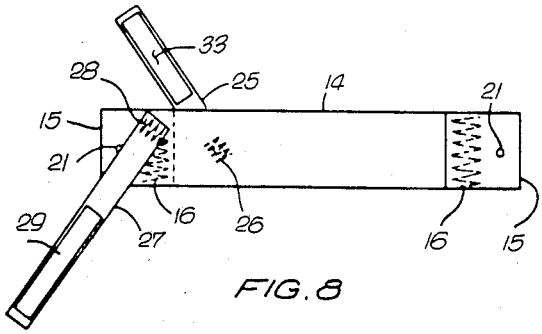
FIG. 8 is a bottom view of the webbing component of the foot holding device laid out flat.

FIGS. 7 and 8 are top and bottom views respectively of the stitched webbing laid out flat. Fasteners 29 and 33, closing strap 25, and heel strap 27 are located and oriented so that these components mate properly when webbing 14 is looped and ends 15 are pinned together thru holes 21.

Figure 9:
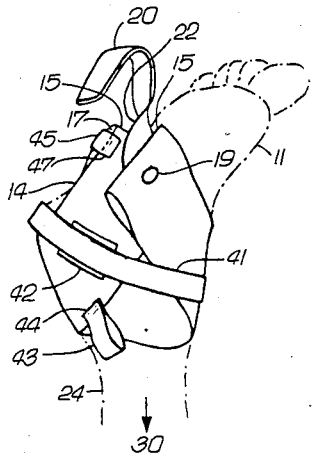
FIG. 9 is a side view of another, preferred embodiment of the foot holding device as viewed toward the inside of the foot. A secured foot is represented in the figure by dot-dash phantom lines.
Figure 10:
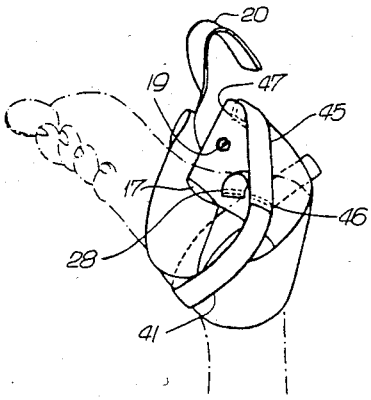
FIG. 10 is a side view of the foot holding device shown in FIG. 9 as viewed toward the outside of the foot. A secured foot is represented in the figure by dot-dash phantom lines.

In the preferred embodiment of FIGS. 9, 10, 11 and 12, the closing strap and heel strap have been combined to form a single crossover strap 41 of flexible material typically one (1) inch wide and sixteen (16) inches long. Strap 41 is attached at one of its ends by stitching 28 near pivot bolt 19. The other end of strap 41 is removably and adjustably attached near the same end but opposite side of webbing 14 by means of a hook and loop fastener 42 of the type commercially referred to as Velcro. Although the use of a hook and loop fastener is the preferred configuration, any one of many types of fasteners or buckles can be used for the same purpose. When wrapped around the foot as shown in FIGS. 9 and 10, the crossover strap 41 functions to hold the foot holding device closed and in place on the foot when hanging tension is not applied.

Supplemental webbing 45 serves to prevent hook 20 from falling sideways away from the foot when hanging tension is not applied. Webbing 45 is typically one (1) inch wide and four (4) inches long. One end of webbing 45 is attached across pocket 17 by stitching 47 and the other end is attached four (4) inches from the attached end of crossover strap 41 by stitching 46.

Loop 43, attached to webbing 14 by stitching 44, serves as a finger pull to aid the user when slipping into or out of the foot holding device. Loop 43 is typically made of one (1) inch wide webbing four (4) inches long and is attached to the edge of webbing 14 at a distance of five (5) inches from the end.

Figure 11:
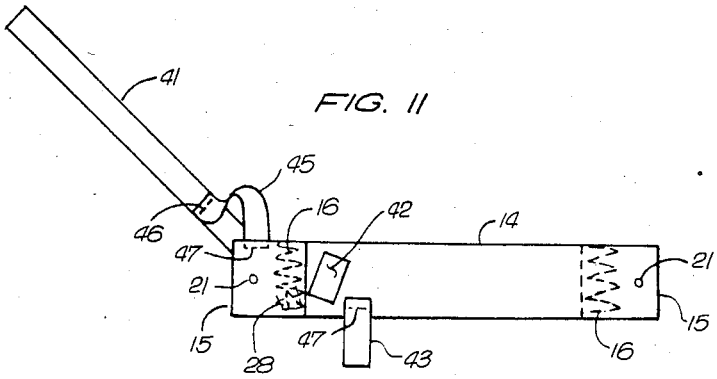
FIG. 11 is a top view of the webbing component of the foot holding device shown in FIG. 9.
Figure 12:
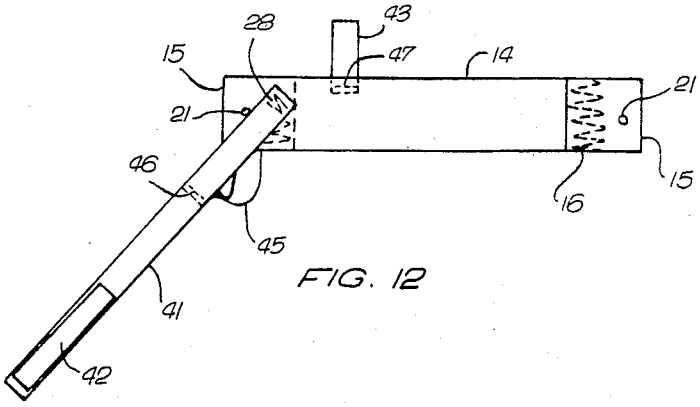
FIG. 12 is a bottom view of the webbing component of the foot holding device shown in FIG. 9.

FIGS. 11 and 12 are top and bottom views respectively of the preferred embodiment laid out flat. Fastener 42 and crossover strap 41 are located and oriented so that these components mate properly when webbing 14 is looped and ends 15 are pinned through holes 21.

In either embodiment, the webbing 14 need not be a continuous, unitary web, but could comprise two sections appropriately joined to permit adjustment of the overall length to accommodate feet of different sizes. Any appropriate connection or joining method can be used, for example, buckles, buttons, clasps, or Velcro.

I claim:

1. A foot holding device for hanging upside-down comprising:

a single elongated, wide flexible web, said web being looped so that the two ends thereof overlap with the obverse face of one end facing the reverse face of the other end, said foot being insertable through the resultant loop so that said single web substantially surrounds the ankle adjacent said foot, with said overlapping ends situated at one side of said foot and with the middle portion of said web situated at the opposite side of said foot, a connector extending through said overlapping ends at said one side of said foot, and holding means for removable attachment of said device to a structural member, said holding means being coupled to said connector and situated adjacent said overlapping ends at said one side of said foot, so that when said holding means is attached to a structural member, said web and hence said ankle and foot will be supported only on said one side thereof, and wherein said connector is a single connector extending through and connecting said overlapping ends.

2. A foot holding device according to claim 1 wherein said holding means comprises a hook, and wherein said connector comprises a pin permitting relative limited rotational movement of each of said overlapping ends and said hook with respect to each other about said pin as an axis.

3. A foot holding device according to claim 2 wherein said hook is formed of a flat strip having a central twist therein to limit relative rotation thereof about said pin.

4. A foot holding device according to claim 2 wherein said hook is formed with protruding tabs to limit relative rotation thereof about said pin.

5. A foot holding device according to claim 1 further comprising first and second rigid members attached to said web at the respective ends thereof, said connector also extending through said rigid members.

6. A foot holding device according to claim 1 further comprising:

a closing strap of flexible material, one end of said closing strap being attached to the reverse face of said web near an end thereof, the other end of said closing strap being removably attachable to the reverse face of said web near the other end thereof.

7. A foot holding device according to claim 1 further comprising:

a heel strap of flexible material, one end of said heel strap being attached to the obverse face of said web adjacent said other end, the other end of said heel strap being removably attachable to the reverse face of said web near the middle thereof.

8. A foot holding device for hanging upside down comprising:

an elongated, wide flexible web, said web being looped so that the two ends thereof overlap with the obverse face of one end facing the reverse face of the other end, holding means for removable attachment of said device to a structural member, a connector extending through said overlapping ends and engaging said holding means, and a unitary closing and heel strap of flexible material having first and second ends, the first end of said unitary closing and heel strap being attached to said web adjacent said other end, the second end of said unitary closing and heel strap being removably attachable to said web near said other end.

9. A foot holding device according to claim 8 wherein said first end of said unitary strap is attached to the obverse face of said web and said second end is removably attachable to the reverse face of said web.

10. A foot holding device according to claim 8 further comprising:

a supplemental webbing extending from said web other end to a near adjacent portion of said unitary closing and heel strap, said supplemental webbing forming a loop to prevent said holding means and the overlapping ends of said web from falling sideways away from the foot when tension is not applied to said foot holding device.

11. A foot holding device for hanging upside-down comprising:

a single elongated, wide flexible web, said web being looped so that the two ends thereof overlap with the obverse face of one end facing the reverse face of the other end, said foot being insertable through the resultant loop so that said single web substantially surrounds the ankle adjacent said foot, a hook for removable attachment of said device to a structural member, and a pin extending through said overlapping ends and engaging said hook, so that when said hook is attached to a structural member said web and hence said ankle and foot will be supported on only one side thereof, said pin permitting relative limited rotational movement of each of said overlapping ends and said hook with respect to each other about said pin as an axis, said hook being formed of a flat strip having a central twist therein to limit relative rotation thereof about said pin, said structural member including a horizontal bar rigidly supported at a height greater than the height of a user of said foot holding device, and wherein said hook includes a generally inverted-J-shaped hook portion adapted to be hooked over said bar, and wherein said twist is approximately 90°, so that when said web is looped about said ankle and said holding means is hooked over said bar, said pin will be situated in a generally horizontal axis that is generally parallel to the ankle axis of said user.

* * * * *